US007041942B2

(12) United States Patent
Gerhardinger

(10) Patent No.: US 7,041,942 B2
(45) Date of Patent: May 9, 2006

(54) HEATING PLATE ASSEMBLY FOR A COOKING APPLIANCE

(75) Inventor: Peter F. Gerhardinger, Maumee, OH (US)

(73) Assignee: Engineering Glass Products, LLC, Chicago, IL (US)

( * ) Notice: Subject to any disclaimer, the term of this patent is extended or adjusted under 35 U.S.C. 154(b) by 110 days.

(21) Appl. No.: 10/696,754

(22) Filed: Oct. 29, 2003

(65) Prior Publication Data

US 2004/0094533 A1 May 20, 2004

Related U.S. Application Data

(60) Provisional application No. 60/426,534, filed on Nov. 15, 2002.

(51) Int. Cl.
*H05B 3/68* (2006.01)

(52) U.S. Cl. ..... 219/450.1; 219/460.1

(58) Field of Classification Search ..... 219/445.1, 219/446.1, 448.11, 450.1, 451.1, 452.11, 219/455.11, 456.1, 458.1, 460.1, 461.1, 465.1, 219/466.1, 543, 546, 547, 548
See application file for complete search history.

(56) References Cited

U.S. PATENT DOCUMENTS 3,047,702 A 7/1962 Lefebvre
3,610,888 A * 10/1971 Button ..... 219/543
4,032,751 A * 6/1977 Youtsey et al. ..... 219/538
4,492,217 A 1/1985 Scheidler
5,420,398 A * 5/1995 Petri et al. ..... 219/505
5,489,764 A * 2/1996 Mannuss et al. ..... 219/448.19
5,679,273 A 10/1997 Petetin
6,037,574 A * 3/2000 Lanham et al. ..... 219/544
6,100,503 A 8/2000 Sasaki et al.
6,194,692 B1 * 2/2001 Oberle ..... 219/543
6,236,024 B1 5/2001 Gotz et al.
2003/0127452 A1 7/2003 Gerhardinger et al.

* cited by examiner

*Primary Examiner*—Sang Paik
(74) *Attorney, Agent, or Firm*—Marshall & Melhorn, LLC

(57) ABSTRACT

A heating assembly is provided for heating objects, for example, food items, that comprises a substrate attached to an insulating frame, which may optionally be attached to a metal pan. The complete assembly is attached to a cooking appliance. The substrate may take the form of a glass disk, for example, tempered soda-lime silica glass, having a conductive coating disposed on one of its surfaces. Conductive metal bus bars, for example, sprayed copper, are disposed onto and in electrical contact with the coating. A temperature sensor may be placed in thermal contact with the heating assembly. As a result, the temperature sensor would allow a cooking appliance to control the electric current being conducted through the heating assembly and, consequently, the temperature of the object being heated.

16 Claims, 1 Drawing Sheet

HEATING PLATE ASSEMBLY FOR A COOKING APPLIANCE

RELATED APPLICATIONS

This application claims the benefit of U.S. Provisional Patent Application Ser. No. 60/426,534, filed Nov. 15, 2002, which application is incorporated herein in its entirety.

BACKGROUND OF THE INVENTION

The present invention generally relates to a heating assembly for heating objects and, more particularly, to a heating assembly for an appliance. Most particularly, the present invention relates to a heating plate assembly for a cooking appliance that uses a thin film to supply heat to food items.

A conventional cooktop appliance is taught in U.S. Pat. No. 4,740,664 to Payne et al., which provides a heating assembly that comprises a metal pan, a fibrous insulation lining, a ring, a heating element, and a cooking surface.

In such a conventional assembly, the metal pan, which mounts the assembly to the cooking appliance, must be substantial enough to encase the various parts and to direct the heat generated by the heating element toward a food item that is being heated. Since the metal pan is thermally conductive, the fibrous insulation lining and ring are required to minimize the heat that might be radiated away from the food item, so as to improve the efficiency of the thermal transfer within the metal pan. However, even with the lining, this form of conventional heating assembly tends to lose heat through the lining.

In addition, the heating element, which is typically shaped in a serpentine pattern, is positioned on the surface of the fibrous insulation away from the cooking surface, which acts to transfer heat to the food item. In effect, this construction prevents direct contact between the heating element and the food item. Since the heating element can be somewhat away from the cooking surface, the heat is not efficiently transferred to the item to be heated. Typically in low temperature cooking, the heating element does not "glow" and hence has poor radiant heat transfer characteristics.

Recently, conductive metal oxide thin films have been disposed on glass and employed in place of conventional heating elements, in a variety of applications, where the films are deposited on a substrate, for example, glass, ceramic, or glass-ceramic, preferably by screen printing, spraying, or chemical vapor deposition (CVD).

U.S. Pat. No. 5,932,128 to Dishop teaches deposition of a thin film to a surface of a substrate that is opposite the actual cooking surface. However, with such a construction, the substrate can become capacitively coupled to a metal cooking container and ionic conductivity through the substrate occurs. Because these effects can cause electrical shock and supply ignition for food fires, Dishop provides an elaborate switching control system to minimize the chance for an occurrence of these effects. This control system, however, adds cost to the heating assembly and does not completely eliminate a potential for electrical shock or eliminate ignition for food fires, if the control system fails.

Typically, warming devices operate at moderated temperatures below the boiling point of water, where gentle warming of clothing, melting butter, or preparing sauces would be examples. Silica glass would be suitable as the substrate for disposing the thin films on warming devices, while conventional electronic solders would be appropriate for connecting the various electrical parts together.

Heating devices, on the other hand, require higher operating temperatures, for example, temperatures at or above the boiling point of water, which are required in the case of true cooking. Heating devices may require special construction materials like ceramic or porcelain steel, where, possibly, ceramic-silver frit bus bars and high temperature solders would be required. However, this construction tends to be costly.

Thus, those skilled in the art continue to seek a solution to the problem of how to provide a better heating assembly for a cooking appliance.

SUMMARY OF THE INVENTION

The present invention relates to a heating assembly that is used for heating objects, like food items. The heating assembly includes a substrate having a major surface that has a conductive coating, such as a doped metal oxide, disposed thereon. Electrical connection to the conductive coating is made by way of, at least two bus bars that are disposed onto and are in electrical contact with the conductive coating. The substrate is brought into mechanical contact with an insulating frame that thermally insulates the substrate from a thermally conductive metal mounting object, for example, a pan or a cooktop, that may be used to contain the heating assembly and may be used to mount the heating assembly to the cooking appliance.

Electrical connecting means, for example, wires, are brought into electrical contact with the bus bars and electrically connected to an appliance power source. Further, a temperature sensor may be placed in thermal contact with the heating substrate or a cooktop, so as to allow an appliance control system to regulate the electrical current that is conducted through the conductive coating on the heating substrate.

Further advantages of the present invention will be apparent from the following description and appended claims, reference being made to the accompanying drawings forming a part of a specification, wherein like reference characters designate corresponding parts of several views.

DETAILED DESCRIPTION OF THE PREFERRED EMBODIMENTS

Figure 1:
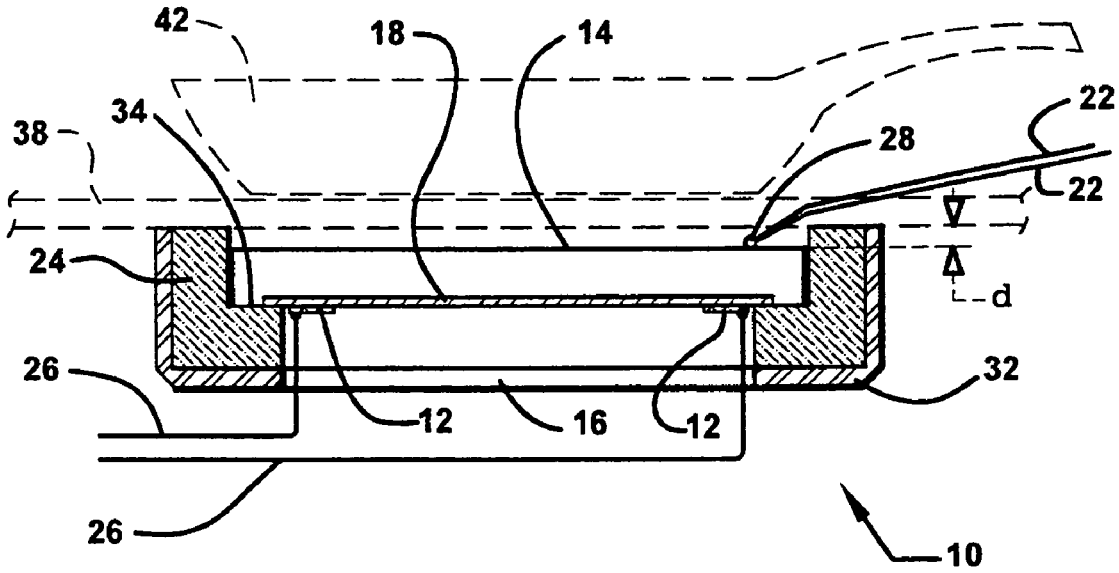
FIG. 1 is a cross-sectional view through the center of an embodiment of a heating assembly in accordance with the present invention.

The present invention involves a heating plate assembly 10, as shown in FIG. 1, where a substrate 14 is shown in a form of a disk 14. It should be appreciated, however, that in the present invention the heating assembly is not limited by its shape, for example, the substrate might comprise other geometrical shapes or it might be formed in various creative shapes, as a cooking appliance design may dictate.

Within the cooking appliance, the heating plate assembly 10 may be incorporated into a cooktop 38, employed as a warming drawer with, for example, the heating plate assembly 10 suspended within the drawer, a countertop "burner", a separate bread warmer, or as a part of other like appliances.

However, it is intended that the present invention not be limited to the heating of only food items 42. Other objects that could be heated are laboratory chemicals, clothing, flooring tiles, liquids, such as, water in aquariums, and gases, such as, air passing through air ducts within buildings.

Figure 2:
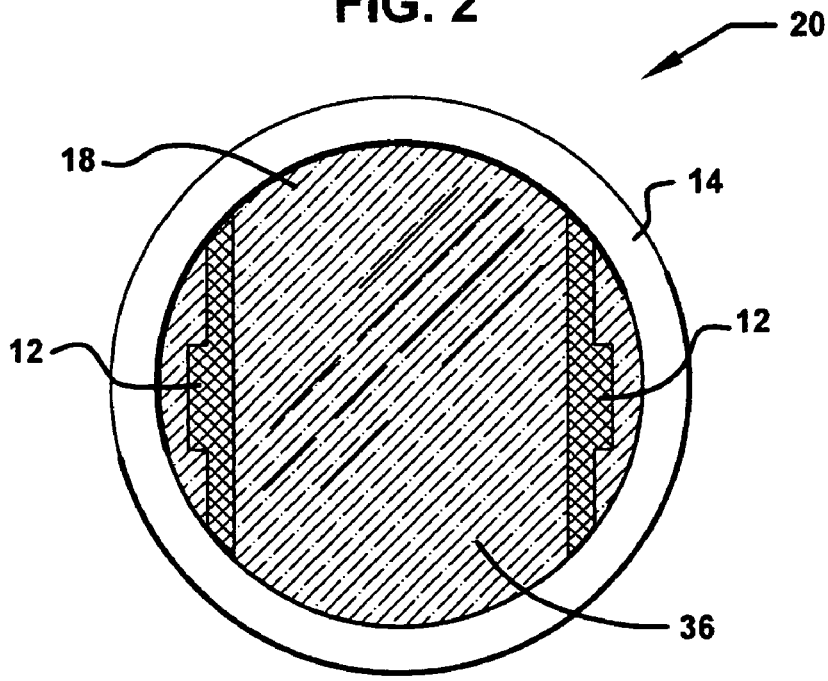
FIG. 2 is a plan view, taken from the conductive coating side of the embodiment of the present invention as shown in FIG. 1.

In conjunction with the heating plate assembly 10 of FIG. 1, FIG. 2 illustrates a conductively coated disk 20 where the disk 14 has a conductive coating 18 disposed on a major surface 34 that is shown in FIG. 1. Subsequently, two bus bars 12 are disposed onto and are in electrical contact with the conductive coating 18. The conductive coating 18 is uniformly disposed on the surface 34, which results in the heating plate assembly 10 more uniformly supplying heat than conventionally constructed heating assemblies. Also, the radiant heat transfer characteristics of the coating 18 are superior to those of conventional heating elements which do not "glow" in warming device applications.

The bus bars 12 could be disposed onto the conductive coating 18 by way of screen printing, for example, ceramic frit/silver bus bars 12, or, spraying or chemical vapor deposition, for example, copper or silver bus bars 12 (see U.S. Provisional Patent Applications Ser. No. 60/339,409, filed Oct. 26, 2001 and Ser. No. 60/369,962, filed Apr. 4, 2002, and U.S. Utility Patent Application Ser. No. 10/256, 391, filed Sep. 27, 2002, which applications are herein incorporated by reference).

For heating devices that operate above the boiling point of water, a substrate 14 that can sustain such temperature, for example ceramic or porcelain steel, would be required. Although ceramic frit/silver bus bars 12 would function properly, the copper bus bars 12 would be a cost effective alternative and would provide a very robust connection to the conductive coating 18.

The conductive coating 18, located between the bus bars 12, defines the heating element 36 of the heating plate assembly 10. As an example, the heating capacity that could be generated by the disk 14 is calculated as follows: assume a 6 inch diameter disk, with an effective heating element 36 composed of an approximate 4 inch by 3.5 inch area, with the coated disk 20 being a coated glass product such as that offered by Pilkington North America, Inc., under the trade name TEC 15 Glass™, having 12.5 ohms per square resistance, while supplying a nominal voltage of 115 VAC, then the heating plate assembly 10 would generate a maximum of about 1200 watts. The heating plate assembly 10, as so described, would be characterized as a heating device burner, as opposed to, for example, a drawer warmer device that might provide 200 to 300 watts of heating capacity.

To further form the heating plate assembly 10, the coated disk 20 is brought into mechanical attachment with an insulating frame 24, which is in the form of a ring when the substrate is a disk 14. Note that the insulating frame 24 itself could be directly attached to an appliance, for example, a cooktop. In a preferred embodiment, the assembly of the coated disk 20 and the insulating frame 24 is brought into mechanical attachment with a pan 32, preferably comprising but not limited to metal, which can have a pan void 16 defined therein. The disk 14, when used as a warming device, may comprise glass, for example, tempered soda-lime silica glass or borosilicate glass, while heating devices may comprise ceramic or a glass-ceramic composite.

Attention is further drawn to FIG. 1, where a dimension "d", which may be on the order of 8 to 12 millimeters, could separate the cooktop 38 from the disk 14. It is expected that this construction would be less costly than conventional heating assemblies since it is more costly to deposit the coating on a ceramic cooktop surface, as taught in U.S. Pat. No. 5,932,128 to Dishop.

Also, by having the cooktop 38 separated from the disk 14, capacitive coupling to a metal cooking container and ionic conductivity through the cooktop substrate are prevented. Thus, electrical shock, ignition for food fires, and a need for an elaborate switching control system are greatly reduced, which also results in cost savings over the various conventional heating assemblies.

The insulating frame 24, which may comprise a thermal insulating material, for example high temperature dielectric material, like refactory type and fryable material, serves to thermally insulate heat generated by the disk 14 from transferring to the appliance or the metal pan 32. This construction is a cost improvement over the conventional construction since the insulating frame 24 and metal pan 32 can be less robust than conventional equivalents, hence the frame 24 and metal pan 32 are less expensive than the conventional metal pan and ring.

By disposing the conductive coating 18 on the major surface 34 away from the item 42, the insulating frame 24 and the metal pan 32 act to insure that the heat generated by the disk 14 is directed to the food item 42 and consequently not wasted. Also, the metal pan 32/insulating frame 24 insure that heat generated by other possible components within the appliance, for example an oven cavity (not shown) during a self cleaning operation, does not raise the temperature in the heating plate assembly 10 and consequently provide unwanted temperature warning signals to an appliance control circuit (not shown).

In the instant invention, by depositing the coating 18 on the surface of the disk 14 that is away from the item 42 being heated, the low emissivity of the coating 18 inhibits the radiation of thermal energy in a direction away from the item 42 to be heated, while not requiring the need for a conventional insulating lining and a bottom in the metal pan 32, thus providing cost savings. By contrast, in the conventional heating assembly much heat is radiated away from the item being heated, which results in loss of thermal energy that consequently is not available for the object being heated.

Further, electrical current needed to power the heating plate assembly 10 would be conducted through heater wires 26, which are disposed on and are in electrical contact with the bus bars 12. A temperature sensor 28 can be placed in thermal contact with the disk 14 or a cooktop 38. As a result, the temperature sensor 28 would communicate, by way of sensor wires 22, the temperature of the substrate being monitored by the heating appliance so that the heating appliance can control the electrical current that flows through the conductive coating 18. This in turn allows the control system of the heating appliance to regulate the temperature of the disk 14.

In addition, a) the present invention possesses faster heating response time since the heating source is much closer to the object being heated, b) the present invention may be used conveniently in the aftermarket to replace conventional heating assemblies, and c) the overall height of the present invention is less than many conventional heating assembly designs, which results in a space savings.

Some of the potential uses for thin film warming and heating devices are: a) warming towels, b) heating air passing through air vents, c) cooking food on ceramic cooktops and countertop burners, and d) warming food in warming drawers. The common purpose of these devices would be to essentially transfer heat to an adjacent surface or article.

In accordance with the provisions of the patent statutes, the principles and modes of operation of this invention have been described and illustrated in its preferred embodiments.

However, it must be understood that the invention may be practiced otherwise than specifically explained and illustrated without departing from its spirit or scope.

What is claimed is:

1. A heating assembly, comprising:

a pan;

an insulating frame, wherein the insulating frame is attached inside the pan;

a sheet of a glass or of a ceramic substrate material, the sheet of substrate material having a major surface with an electrically conductive low emissivity thin film deposited uniformly thereover, the thin film comprising a doped metal oxide, wherein the sheet of substrate material is attached to the insulating frame; and at least two bus bars, the bus bars being disposed onto the doped metal oxide thin film and in electrical contact therewith, the bus bars and electrically conductive thin film being capable of carrying electrical heating currents.

2. The heating assembly of claim 1, wherein the insulating frame comprises a ring.

3. The heating assembly of claim 2, wherein the pan comprises metal.

4. The heating assembly of claim 3, wherein the pan is attached to a cooktop.

5. The heating assembly of claim 1, wherein the insulating frame comprises a high temperature dielectric material.

6. A warming device comprising the heating assembly of claim 1, wherein the substrate is comprised of borosilicate glass or tempered soda-lime silica glass.

7. A warming drawer comprising the warming device of claim 6.

8. A bread warmer comprising the warming device of claim 6.

9. A heating device comprising the heating assembly of claim 1, wherein the substrate is comprised of a or glass-ceramic composite.

10. A cooktop comprising the heating device of claim 9.

11. The cooktop of claim 10, wherein the pan is attached to a cooktop and the cooktop is spaced apart from the substrate by a dimension in the range of 8 to 12 mm.

12. A countertop burner comprising the heating device of claim 9.

13. The heating assembly of claim 1, further comprising at least one temperature sensor in thermal contact with the substrate or cooking surface.

14. The heating assembly of claim 13, further comprising an appliance control system that communicates with the temperature sensor to regulate the electrical current that is conducted through the thin film, thus controlling the heating of the heating assembly.

15. The heating assembly of claim 1, wherein the bus bars comprise copper disposed by way of a heating head and mask apparatus.

16. A cooking appliance, comprising:

a cooktop;

a metal pan, wherein the metal pan is attached to the cooktop;

an insulating ring, wherein the insulating ring is attached inside the pan;

a sheet of a glass or of a ceramic substrate material, the sheet of substrate material having a major surface with an electrically conductive low emissivity thin film deposited uniformly thereover, the thin film comprising a doped metal oxide, wherein the sheet of substrate material is attached to the insulating ring; and at least two bus bars, the bus bars being disposed onto the doped metal oxide thin film and in electrical contact therewith, the bus bars and electrically conductive thin film being capable of carrying electrical heating currents.

* * * * *